US005894267A

United States Patent [19]

Blair

[11] Patent Number: 5,894,267

[45] Date of Patent: Apr. 13, 1999

[54] TILT DETECTOR FOR ROLL-UP DOOR

[76] Inventor: William John Blair, 63 Boulder Crescent, Guelph, Ontario, Canada, N1G 5A2

[21] Appl. No.: 08/824,969

[22] Filed: Mar. 27, 1997

[51] Int. Cl.[6] ..... G08B 1/08

[52] U.S. Cl. ..... 340/545; 340/689; 73/865.9

[58] Field of Search ..... 340/545, 689; 49/31; 73/865.9; 200/61.52

[56] References Cited

U.S. PATENT DOCUMENTS

| | | | |
|---|---|---|---|
| 3,710,369 | 1/1973 | Takahashi | 340/274 |
| 3,827,038 | 7/1974 | Willis | 340/224 |
| 3,975,723 | 8/1976 | Bowling et al. | 340/274 |
| 4,124,847 | 11/1978 | Cashman | 340/545 |
| 4,232,309 | 11/1980 | Dillitzer | 340/547 |
| 4,253,095 | 2/1981 | Schwarz et al. | 340/691 |
| 4,583,081 | 4/1986 | Schmitz | 340/545 |
| 4,593,491 | 6/1986 | Carlson et al. | 49/13 |
| 4,633,232 | 12/1986 | Nelson et al. | 340/542 |
| 4,868,543 | 9/1989 | Binkley | 340/569 |
| 5,402,105 | 3/1995 | Doyle et al. | 340/539 |

*Primary Examiner*—Hezron Williams
*Assistant Examiner*—Nashmiya Fayyaz
*Attorney, Agent, or Firm*—Anthony Asquith & Co.

[57] ABSTRACT

The device is based on a tilt-sensing switch of the mercury-bridges-gap type. The device measures the tilt angle of the bottom slat of a roll-down door. If the slat becomes tilted, due for example to one end of the slat becoming snagged in the guideway at the side of the door, the sensor detects the tilt, and arrests the downwards movement of the door, before the slats can spill out and escape from the guideway.

12 Claims, 5 Drawing Sheets

TILT DETECTOR FOR ROLL-UP DOOR

This invention relates to an operable roll-up/roll-down door, and in particular to a device for detecting when the motion of the door has gone awry.

BACKGROUND TO THE INVENTION

Roll-up/roll-down doors are well-known, in many configurations. The invention is concerned with the type of door which comprises horizontal slats or segments, the ends of which run in tracks or guideways. The door is operable, generally, by means of an electric motor. The door is counterbalanced by a spring coiled around an actuation spindle, or by counterweights, etc.

A problem that can arise with such doors is that the slats may snag in the guideways. If one end of a slat becomes snagged in the guideway, while the door is descending, the slat will tilt. The other end of the slat continues descending, and, because of the tilt, reaches an angle at which the end of the slat is no longer contained within the guideway. From then on, the slats tend to spill out of the guideways.

When that happens, inevitably some of the slats will become twisted, and some of the hinges between the slats will be strained. Even if the slats can be put back in the guideways, after such an occurrence, the door is likely never to operate smoothly, and also to become increasingly prone to become snagged again in the guideways.

The invention is aimed at providing a tilt-detecting device, which may be attached to the door, and which is effective to detect the onset of the slat-snagged condition, and to arrest the motion of the door before any damage is done, and especially before the slats can spill out of the guideways.

1. General Features of the Invention

The invention provides a tilt-detecting device, which is attached preferably to the bottom slat of a hinged-slat type, raisable/lowerable door. The device includes means for detecting when a slat of the door undergoes a tilt of more than a predetermined angle Q, in the left/right sense of the door, the angle Q lying in the plane of the door. The device also includes a means for arresting motion of the door upon detecting, and in response to, the said tilt.

The device of the invention permits the door to be used in the normal way, in which the degree of attention paid to the door itself, by the users, is extremely casual, and servicing of the door is, as is all too often the case, neglected.

2. The Invention in Relation to the Prior Art

There have been many examples of various arrangements of detectors for detecting the position of a door. These have concentrated on the degree of the door's opening and closing, for many purposes, including: control of the powered open/close motor of the door of a factory; detecting unauthorised entry; fire control; automatic ventilation; and so on. Often, these sensors have detected changes in the angular position of the door (or window).

The invention, by contrast, detects the angle of tilt of the door, i.e the tilt in the left/right sense, in the plane of the door.

DETAILED DESCRIPTION OF PREFERRED EMBODIMENTS

By way of further explanation of the invention, exemplary embodiments of the invention will now be described with reference to the accompanying drawings, in which.

The apparatuses shown in the accompanying drawings and described below are examples which embody the invention. It should be noted that the scope of the invention is defined by the accompanying claims, and not necessarily by specific features of exemplary embodiments.

Figure 1:
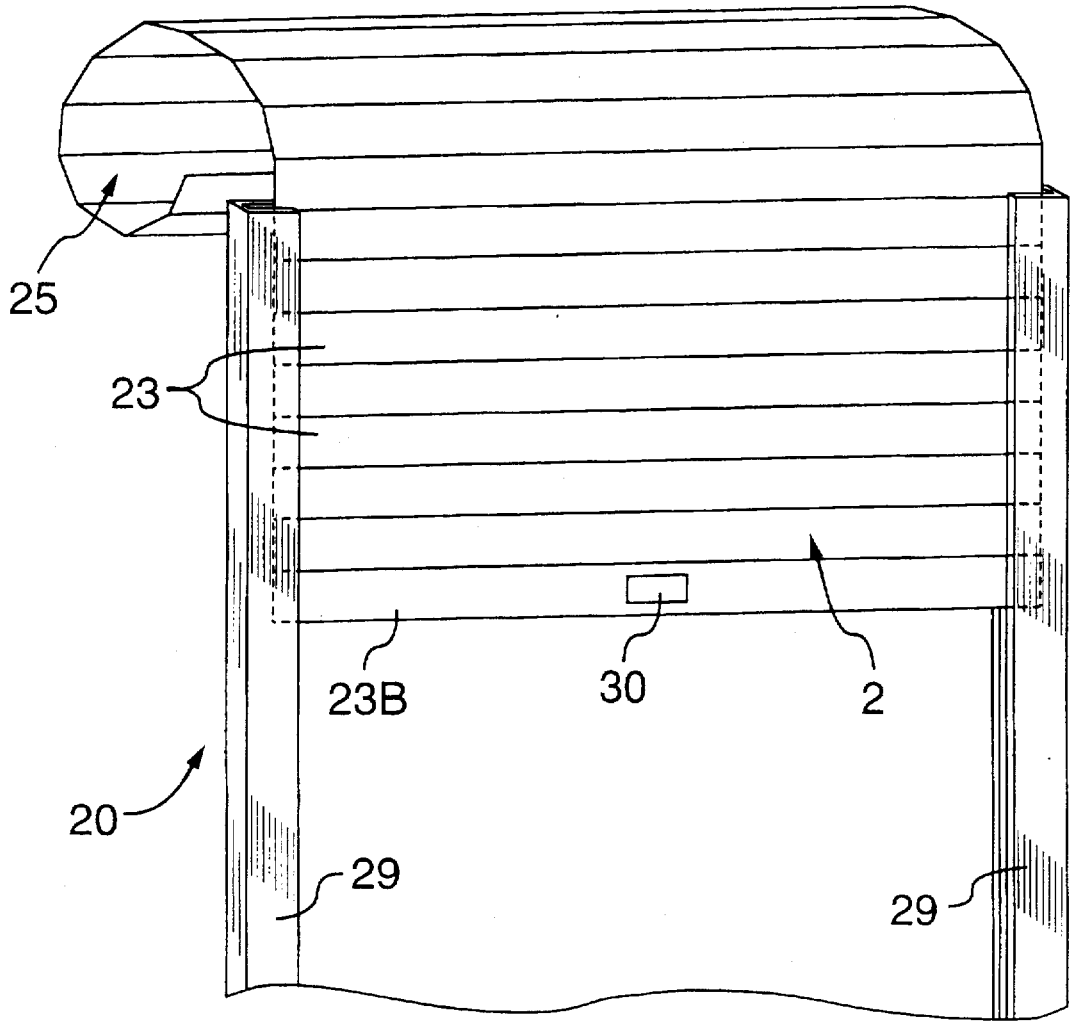
FIG. 1 is a front elevation of an operable roll-up/roll-down door which incorporates the safety device of the invention.

FIG. 1 shows a roll-up/roll-down door and doorway assembly 20. The door 21 is formed of many slats 23, which are all hinged together along their long edges. When the door is open, the slats are rolled into a coil 25, which is stored at the top of the doorway. Alternatively, the opened door may be stored with the slats disposed in a horizontal plane, above the doorway.

The doorway 27 is provided with left and right guideways 29. These are in the form of channels, in which run the lateral ends of the slats.

The slats are of course loose in the channels, so that the slats can pass up and down freely as the door is opened and closed. Occasionally, perhaps due to the guideway being accidentally struck, or for some other reason, a place on the guideway can arise where the movement of the slats is interfered with.

If the door is being pulled up, generally the slats can be pulled through and past the place of obstruction; but when the door is being lowered, what happens is that the bottom slat 23B, when it encounters the place of obstruction in the one guideway, now is not receiving the benefit of a force pulling the bottom slat down; rather, the bottom slat is being pushed down by the weight of the slats above. As a result, the bottom slat tends to roll over, and then to jam across the guideway.

Meanwhile, the other end of the slat, in the other guideway, is proceeding downwards, unchecked. The bottom slat therefore becomes tilted, in the left/right sense, i.e. across the doorway, and in the plane of the door.

It is all too easy for the door slats to be bent and damaged when this occurs, and then the problem lies in restoring the guideway and the slats to a condition in which the door can once more slide up and down freely. All too often, the slats, and the guideway, are so damaged that the door has to be replaced.

Of course, theoretically it is possible for the person who is operating the door to immediately switch off the door roll-down operation, as soon as he sees the bottom slat start to tilt. However, the reason the door was opened probably was that the person wished to move a load through the door, or to drive a vehicle through the door. After passing through, the person hits the control button to lower the door, and then, most likely, drives off in the vehicle, or takes up the load again, etc, and is in no position to break off, and take prompt action to cause the door motion to be arrested.

Figure 2:
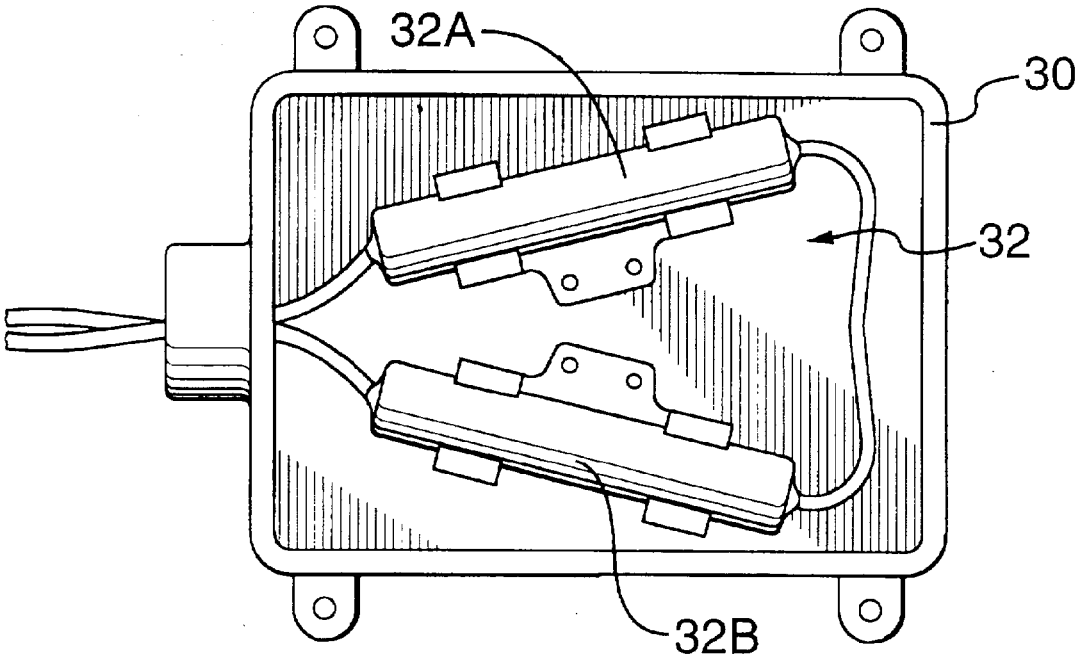
FIG. 2 is a diagram of the physical components of the safety device.

In FIG. 1, a box 30 is bolted to the bottom slat 23B. The box contains a tilt-detector 32, which, as shown in FIG. 2, comprises two mercury tilt-switches 32A,32B.

Figure 3:
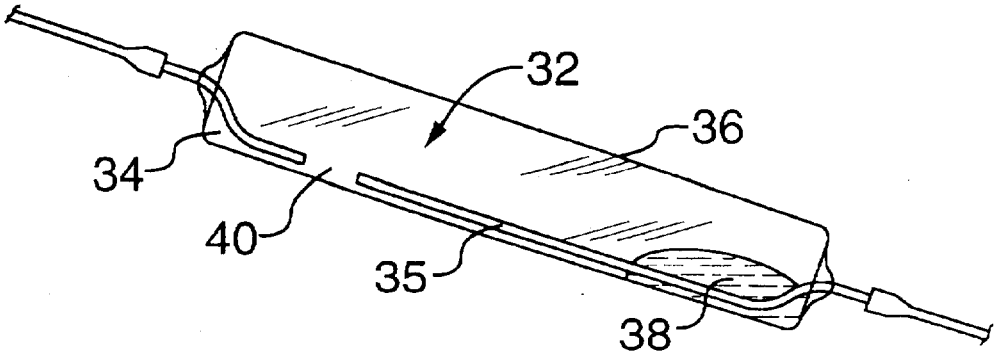
FIG. 3 is a close-up of one of the components of the safety device.

These switches are of conventional construction, per se, as shown in FIG. 3. Left and right electrodes 34,35 are embedded in a glass phial 36, along with a blob 38 of mercury. When the phial is right-end-down, as shown in FIG. 3, the blob resides at the right end, and the gap 40 between the two electrodes is open, and the switch is OFF. When the phial is left-side-down, the blob lies over the gap 40, and current can pass through the mercury, and the switch is ON.

Switches of the type shown in FIG. 3, that operate when they are tilted, are conventional per se. Two of the FIG. 3 switches are required, as shown in FIG. 2, in order to detect tilting of the bottom slat 23B either clockwise or anti-clockwise.

The switches 32A,32B are arranged in the box 30 such that both switches are normally ON when the box is level. When the box is tilted, the appropriate one of the switches will go to the OFF condition. The switches are connected to each other in series, and so the box, as a whole, conducts if it is level, but does not conduct if it is tilted either way. Only two wires run to the box.

Figure 4:
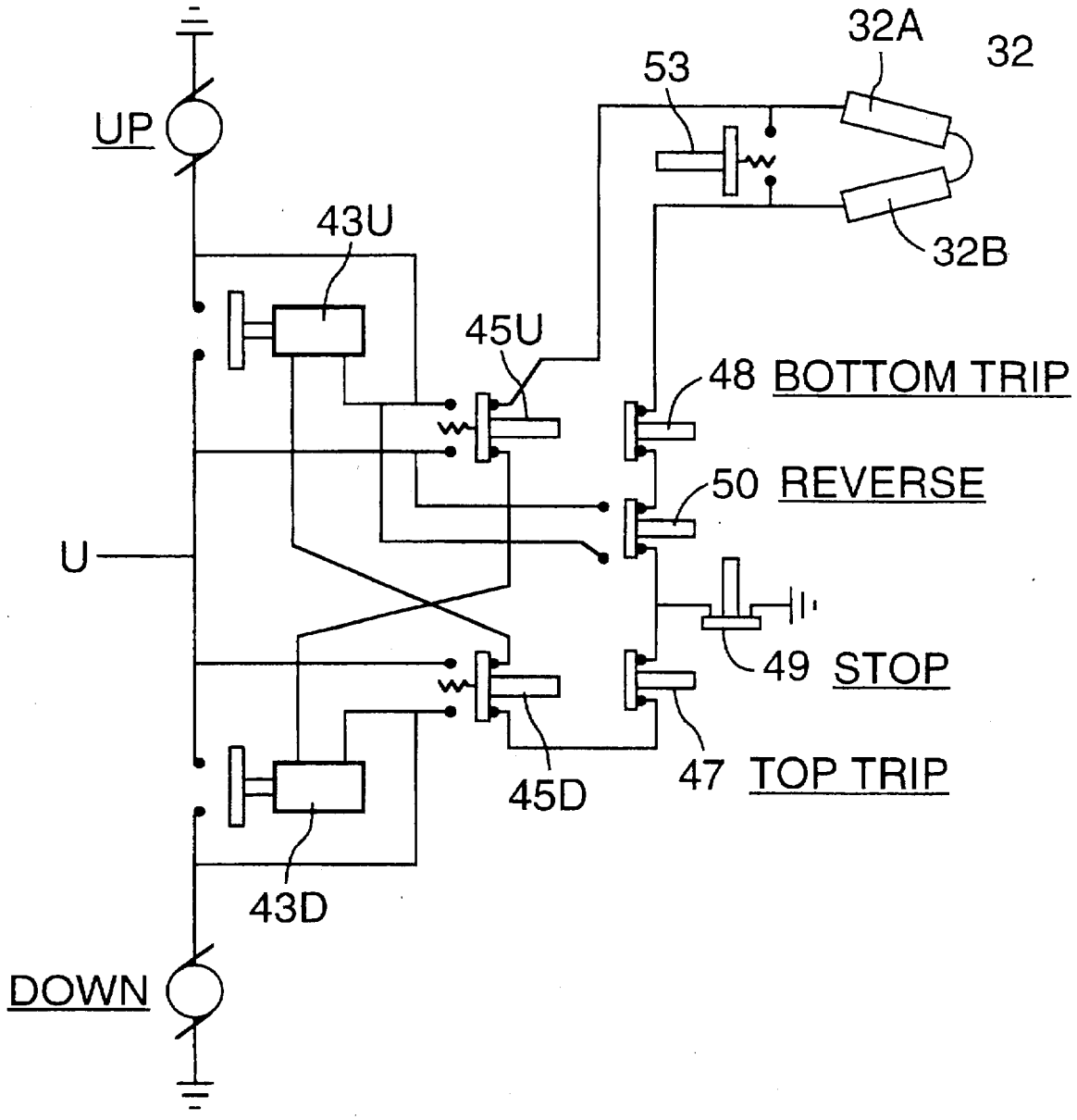
FIG. 4 is a diagram of the electric circuit of the door, showing the incorporation of the safety device.

FIG. 4 shows how the switches 32A,32B are connected into the type of circuit that controls the door movement. The circuit shown in FIG. 4 is merely an example, but suffices to illustrate that the switches 32A,32B should be placed where the effect of the switches going to OFF is to stop the movement of the door.

Some door installations have the feature that if the door strikes an obstruction on the way down, the door does not stop, but reverses. If that were done when the door tilted, however, whilst sometimes that might cause the obstruction to clear, in another case further damage might be caused. Therefore, when the tilt detector 32 detects that the door has tilted, the result should be that the door stops. When the operators can assess what is causing the problem, then the door may be raised, if that is seen to be likely to be effective.

In FIG. 4, the up and down motions are determined by relays 43U,43D, which are activated by push-buttons 45U, 45D. Each relay is so connected as to be self-latching when its button is pressed momentarily and then released, and the circuit includes the usual safeguards in case both buttons are pressed at the same time.

When the buttons are released, the motor remains activated in UP or DOWN mode until the appropriate one of the top-of-travel 47 or bottom-of-travel 48 trip switches are triggered, whereupon the motor stops.

The sensor for detecting when the downwards-moving door has struck an obstruction and should reverse upwards, is shown at 50. Activation of the sensor 50 first causes the latch holding the DOWN solenoid 43D to be disabled, and then activates the UP solenoid 43U.

As mentioned, the tilt-detecting device 32 should be coupled in in such a way that it will cause the motor to stop, not where it will cause the motor to reverse. Placing the tilt-detector directly in series with preferably the bottom-of-travel trip switch will usually be satisfactory, and it is usually fairly easy to break into the trip-switch wires.

In some installations, a STOP switch 49 is provided, for halting the movement of the door at an intermediate point. The tilt-detector device 32 may be placed directly in series with that switch, if convenient.

Whilst it is possible for the tilt switches to be placed directly in the power line which supplies current to the motor, that, however, is not the intention, and is not preferred, for obvious safety reasons. It is much preferred that the tilt detector device be coupled into the (preferably low voltage) control circuit, which is found on most door installations.

The tilt detector device preferably is provided with a manually-operated by-pass switch 53 (FIG. 4). The by-pass switch allows the door to be raised (or even lowered) while the slats remain tilted, and the tilt detector is OFF. The operators, having determined the cause of the tilting, may decide that it would be useful to raise the door, once the obstruction has been cleared. The by-pass or over-ride switch 50 may be built into the box 30. Preferably, the switch 53 should be of the kind that has to be manually held on, in order to remain activated, so that it cannot remain on accidentally.

The tilt switches 32A,32B should be set in the box 30 at the correct angle. The mercury in tilt switches can move around in the phial very easily, and the vibrations and jerks and rattles of a descending door might cause the mercury to break the gap 40, if the switch were set over-sensitively. From the standpoint that the switch should not be too sensitive, the switch should preferably be arranged at a slope of about 5 degrees beyond the horizontal, ie beyond the level at which the gap 40 is just broken.

On the other hand, the switch should be set sensitively enough that the switch will activate as soon as the bottom slat is becoming tilted, i.e before the slat has become so tilted that the door might be damaged. From the opposite standpoint, that the switch should be sensitive enough, the switch should preferably be arranged at an angle of less than 15 degrees from the horizontal.

A setting of 10 degrees provides a good compromise of sensitivity. The switches 32A,32B should be of the type that will not be affected by being rolled over, because in some door installations the bottom slat 23B turns horizontal, or almost horizontal, when the door is fully open. If that motion of the slat were to make the switches go OFF, the door could not be lowered.

Alternatively, the box 30 may be mounted on the bottom slat in such a manner that the switch phials are angled outwards, ie towards the front of the door. The installer of the tilt-detector would measure at what angle the bottom slat 23B resides when the door is fully open: if that angle is, say, 60 degrees to the vertical when the door is fully open (assuming the bottom slat is vertical when the door is closed, he would set the box angled forwards 30 degrees. That way, the phials in the box never go more than 30 degrees from the vertical.

The box may include provision for adjusting the front/rear orientation, or it may be arranged that the phials are set so as to slope forwards (in addition to the left/right slopes as described herein) by up to 45 degrees.

Figure 5:
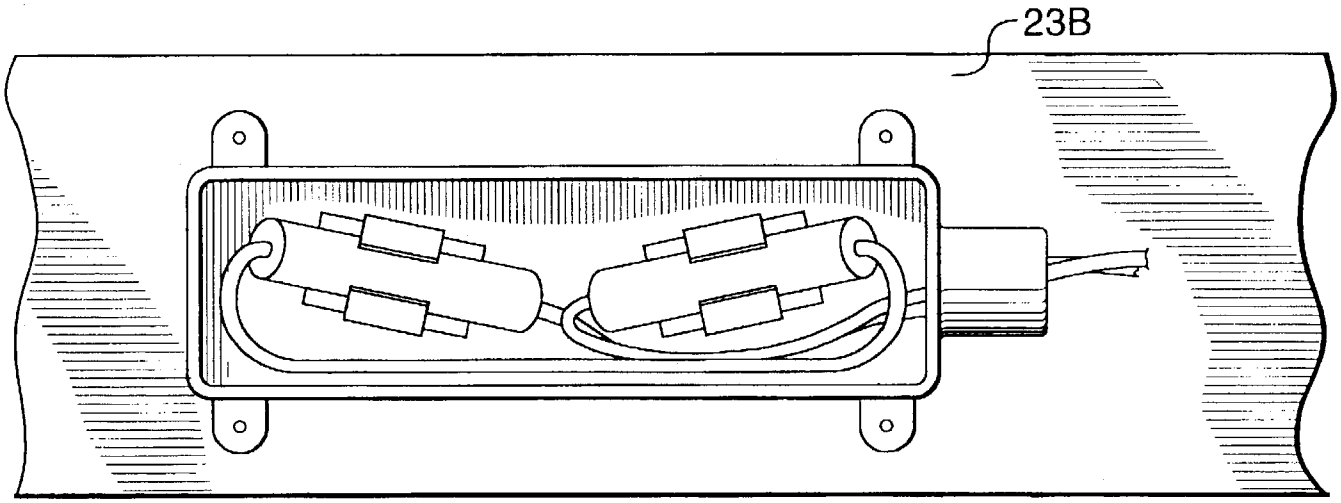
FIG. 5 is a front elevation of a modified device.
Figure 6:
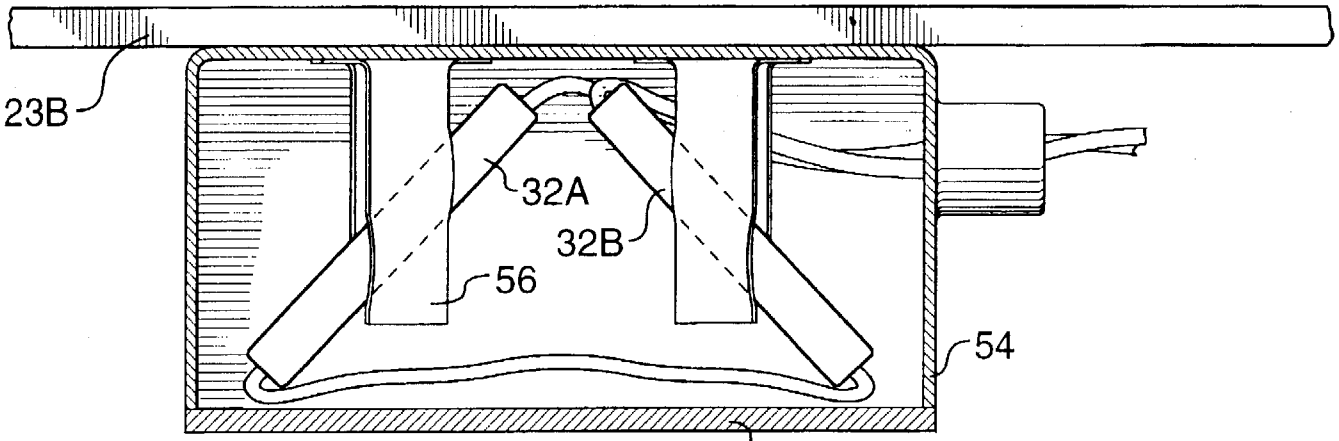
FIG. 6 is a plan view of the device of FIG. 5.

FIGS. 5 and 6 show the tilt switches arranged accordingly. FIG. 5 is the view from in front of the door (with the cap 52 removed from the housing 54), and shows the DOWN ends of the phials towards the centre. Clips 56 hold the phials in the correct orientation. FIG. 6, which is a plan view from above, shows that the DOWN ends of the phials lie closest to the slat. Thus, the UP ends remain always up, and the DOWN ends always down, even if the slat rolls to a horizontal position when the door is fully open. The switches still retain the required sensitivity to left/right tilt of the bottom slat.

Figure 7:
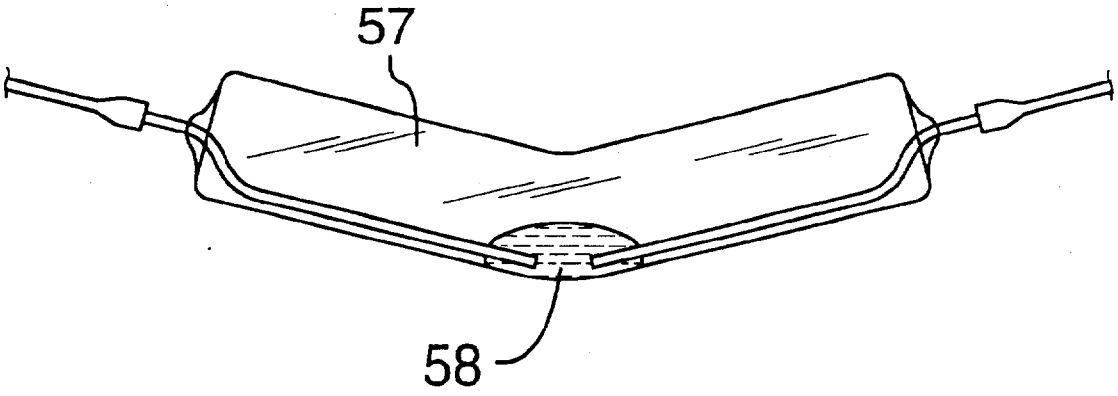
FIG. 7 is a close-up of an alternative to a pair of the components shown in FIG. 3.

FIG. 7 shows another type of tilt-detecting switch which may be used in the invention. Here, the phial itself 57 is Vee-shaped, and the gap 58 between the electrodes is in the centre. Only one switch of that type is required. Again, the arms of the Vee may be sloped forwards at up to 45 degrees.

The tilt detector should be placed preferably on the very bottom slat, and in a place where installation of the box and wiring is convenient, and where it is unlikely the box will be damaged during operation and use of the door. The designer of the device should have it in mind that the device will likely be knocked occasionally, and the components should be sturdy and well-mounted.

I claim:

1. Tilt-detecting device, for use upon a hinged-slat type, raisable/lowerable door, the door having a front, back, top, bottom, and left and right sides, wherein:

the device includes a housing, and includes a means for attaching the housing to the door, at or adjacent to the bottom of the door;

the device includes means for detecting when a slat of the door undergoes a tilt of more than a predetermined angle Q, in the left/right sense of the door, the angle Q lying in the plane of the door;

the device includes a means for arresting motion of the door upon detecting, and in response to, the said tilt.

2. Device of claim 1, wherein the angle Q is more than 5 degrees.

3. Device of claim 1, wherein the angle Q is less than 15 degrees.

4. Device of claim 1, wherein the door is provided with an electrically powered raising and lowering means;

the means for detecting the tilt includes an electric tilt-sensing switch, which is effective to issue an electric signal upon detecting the said tilt;

and the means for arresting the motion of the door comprises a means responsive to the said electric signal, for disabling the said raising and lowering means.

5. Device of claim 4, wherein:

the electric tilt-sensing switch comprises a phial, fitted with two electrodes, and a gap therebetween, and a blob of mercury;

the structural arrangement of the tilt-sensing switch is such that when the degree of tilt of the phial changes, the blob moves from bridging the gap to not bridging the gap.

6. Device of claim 5, wherein:

the device includes also a second tilt-sensing switch, which is effective to issue an electric signal upon detecting tilt;

the two switches are so arranged in the device such that when, during use of the device, the slat becomes tilted, the two switches are arranged one to detect tilt of the slat to the left and the other to detect tilt of the slat to the right.

7. Device of claim 6, wherein the two switches are arranged electrically in series.

8. Device of claim 7, wherein the phials of the two switches are both inclined forwards at angle X, lower ends of the phials being nearer the slat than upper ends of the phials.

9. Device of claim 8, wherein the angle X is between 30 and 45 degrees.

10. Device of claim 5, wherein the phial is Vee-shaped, and the gap between the two electrodes is located at the apex of the Vee-shape.

11. Device of claim 4, in combination with the door, wherein:

the door is equipped with a control circuit including a trip switch, for detecting an extremity of downwards movement of the door;

the trip switch is so arranged as to provide continuity of circuit until tripped;

the trip switch is effective, upon being tripped, to break the said control circuit;

and the tilt-sensing switch is arranged in series with the said trip switch.

12. Device of claim 4, wherein the device includes a manually-operable over-ride switch, arranged in parallel with the tilt-sensing switch.

* * * * *